US009388826B2

(12) United States Patent
Liu et al.

(10) Patent No.: US 9,388,826 B2
(45) Date of Patent: Jul. 12, 2016

(54) HEAT DISSIPATING FAN WITH LATERAL AIR INLET AND OUTLET

(71) Applicants: Chih-Jen Liu, New Taipei (TW); You-Wei Hsu, New Taipei (TW)

(72) Inventors: Chih-Jen Liu, New Taipei (TW); You-Wei Hsu, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 833 days.

(21) Appl. No.: 13/657,880

(22) Filed: Oct. 23, 2012

(65) Prior Publication Data

US 2013/0170968 A1 Jul. 4, 2013

(30) Foreign Application Priority Data

Dec. 29, 2011 (TW) ..... 100149519

(51) Int. Cl.
*F04D 29/40* (2006.01)
*F04D 29/42* (2006.01)
*F04D 17/04* (2006.01)

(52) U.S. Cl.
CPC ..... *F04D 29/4226* (2013.01); *F04D 17/04* (2013.01)

(58) Field of Classification Search
CPC ..... F04D 17/02; F04D 17/04; F04D 17/16; F04D 29/40; F04D 29/403; F04D 29/42; F04D 29/422; F04D 29/4226; F05B 2240/14; F05B 2250/50; F05B 2250/501; F05B 2250/5011; F05B 2250/5012; F05B 2250/502
USPC ..... 415/53.1, 58.6, 203, 224; 416/178
See application file for complete search history.

(56) References Cited

U.S. PATENT DOCUMENTS

| | | | | |
|---|---|---|---|---|
| 3,695,775 | A * | 10/1972 | Zenkner | F04D 17/04 415/119 |
| 7,492,587 | B2 | 2/2009 | Chang | |
| 7,688,579 | B2 | 3/2010 | Hwang et al. | |
| 2007/0097635 | A1 | 5/2007 | Chang | |
| 2010/0232948 | A1* | 9/2010 | Horng | F04D 17/16 415/182.1 |
| 2012/0207596 | A1* | 8/2012 | Chou | F04D 29/4226 415/224 |

FOREIGN PATENT DOCUMENTS

CN 1955880 A 5/2007

* cited by examiner

*Primary Examiner* — Craig Kim
*Assistant Examiner* — Alexander White
(74) *Attorney, Agent, or Firm* — ScienBiziP, P.C.

(57) ABSTRACT

An exemplary heat dissipating fan includes a frame and an impeller rotatably received in the frame. The frame includes a base and a top cover disposed on the base, the base includes a bottom plate a peripheral sidewall. The sidewall extends between the bottom plate and the top cover, and the base and the top cover cooperatively defines a receiving space. The impeller is rotatably received in the receiving space. The top cover, the bottom cover and the sidewall cooperatively define an air inlet therebetween. The top cover, the bottom plate and the sidewall cooperatively define an outlet therebetween. The air outlet is generally adjacent to and substantially perpendicular to the air inlet.

15 Claims, 6 Drawing Sheets

HEAT DISSIPATING FAN WITH LATERAL AIR INLET AND OUTLET

BACKGROUND

1. Technical Field

The present disclosure generally relates to fan devices in electronic equipment, and more particularly to a heat dissipating fan with a low profile typically used for removing heat from an electronic package.

2. Description of the Related Art

With the continuing development of electronics technology, electronic packages such as CPUs (central processing units) employed in electronic devices are generating more and more heat. A heat dissipation device such as a heat dissipating fan is commonly used in combination with a heat sink for cooling the electronic package.

For portable computer systems such as notebook computers, there is a trend toward them becoming miniaturized. In particular, it is desired that a notebook computer have a low profile, to meet the requirements of consumers. Accordingly, a heat dissipating fan provided in the notebook computer is required to have a reduced axial size.

A traditional heat dissipating fan includes a frame and an impeller received in the frame. The frame includes a top cover, a bottom plate, and a sidewall interconnecting the top cover and the bottom plate. The top cover and the bottom plate define two air inlets, respectively, and an air outlet is defined in a portion of the sidewall. When the heat dissipating fan is assembled in a housing of a notebook computer, a gap must be defined between the housing of the notebook computer and the top cover, and another gap must be defined between the housing of the notebook computer and the bottom plate, for allowing air to flow into the air inlets. Therefore the axial size of the heat dissipating fan is small, and a height of the bearing in the heat dissipating fan is correspondingly small. This means the supporting capability of the bearing is reduced, and a volume of oil contained in the bearing is reduced. Thus, the heat dissipating fan is liable to fatigue and weaken, and the working lifetime of the heat dissipating fan is liable to be short.

Therefore, it is desirable to provide a heat dissipating fan which can overcome the above-described problems.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present heat dissipating fan. Moreover, in the drawings, like reference numerals designate corresponding parts throughout the views.

DETAILED DESCRIPTION

Figure 1:
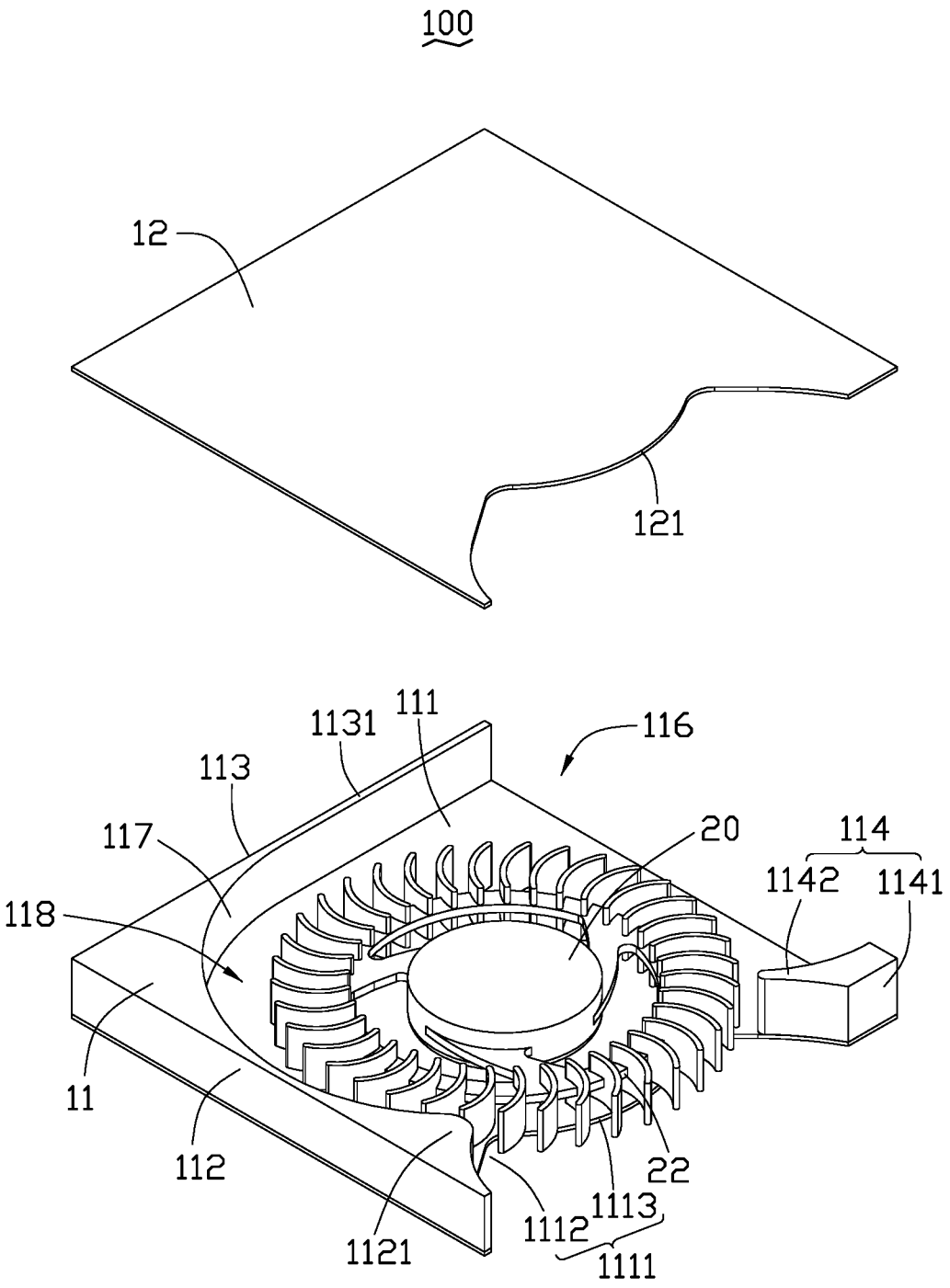
FIG. 1 is an exploded, isometric view of a heat dissipating fan in accordance with an embodiment of the disclosure.
Figure 2:
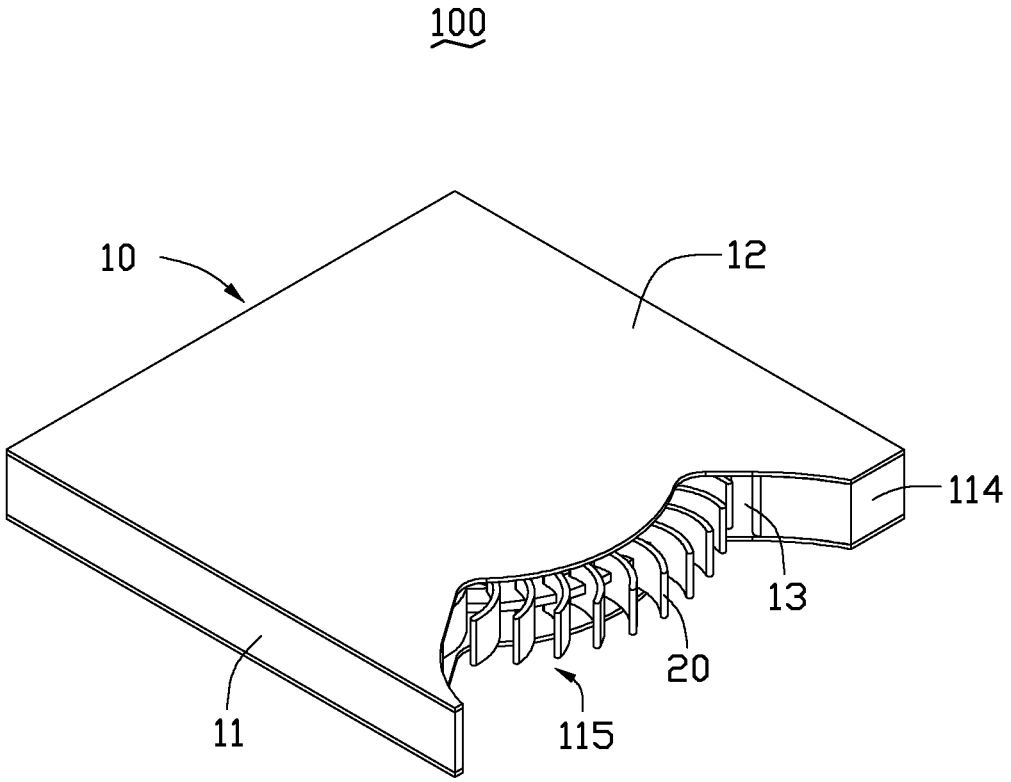
FIG. 2 is an assembled view of the heat dissipating fan of FIG. 1.
Figure 3:
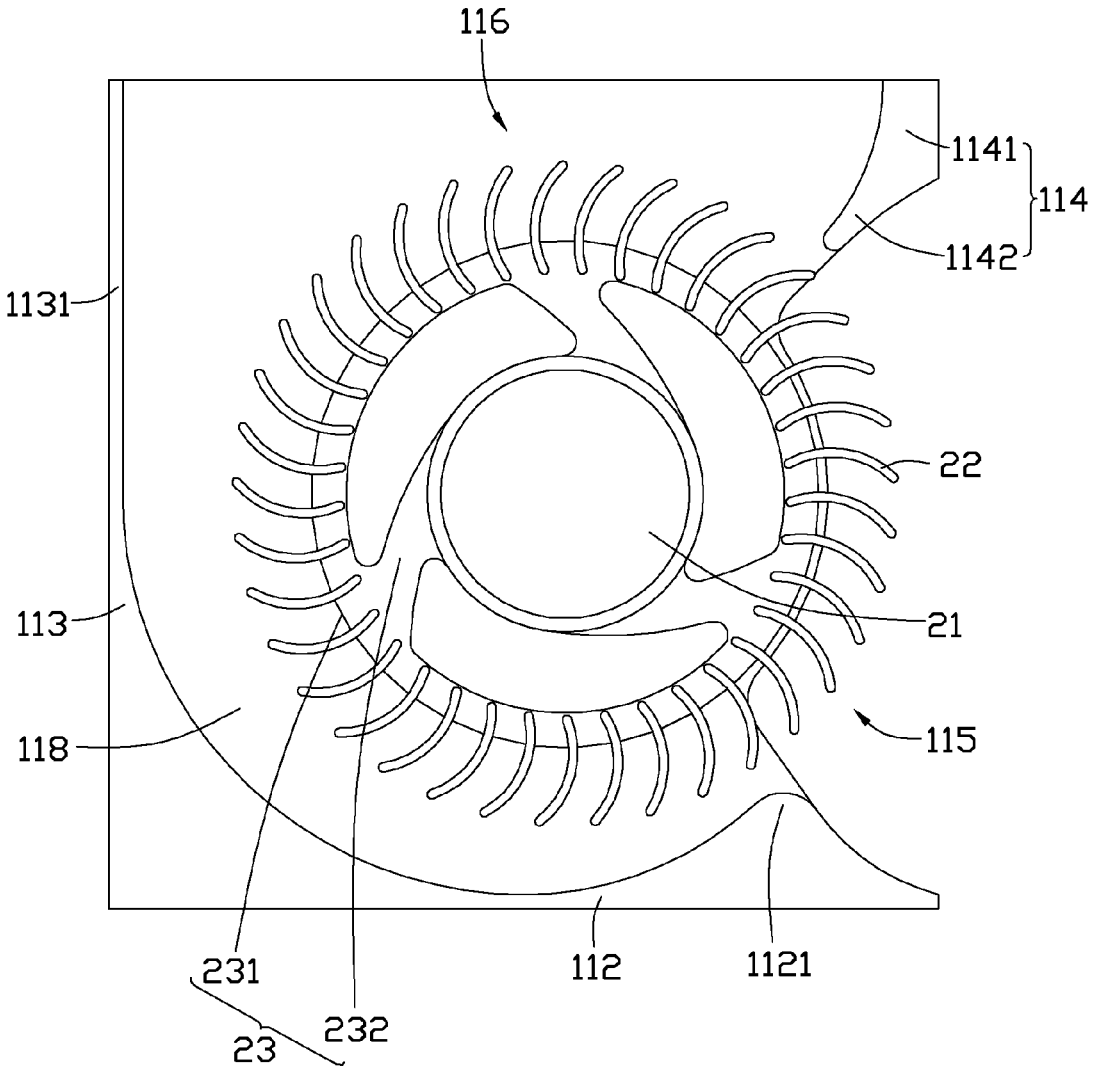
FIG. 3 is a top plan view of the heat dissipating fan of FIG. 1, wherein a top cover thereof is omitted.

Referring to FIG. 1 through FIG. 3, a heat dissipating fan 100 in accordance with an exemplary embodiment is shown.

The heat dissipating fan 100 includes a frame 10, and an impeller 20 received in the frame 10. The heat dissipating fan 100 is disposed in an electronic device (not shown) for removing heat therefrom.

Specifically, referring to FIG. 1 and FIG. 2, the frame 10 includes a base 11 and a top cover 12. The base 11 and the top cover 12 are engaged together to cooperatively form a receiving space 13. The base 11 includes a bottom plate 111, and a first sidewall 112, a second sidewall 113 and a third sidewall 114 extending upward from a lateral periphery of the bottom plate 111. The first sidewall 112 connects the second sidewall 113. The third sidewall 114 is spaced from the first sidewall 112 and the second sidewall 113.

The bottom plate 111 is flat. A portion of the bottom plate 111 positioned between the first sidewall 112 and the third sidewall 114 is cut to form a first depressed portion 1111. The first depressed portion 1111 is generally W-shaped. In particular, the first depressed portion 1111 defines two symmetrical notches 1112, with the first depressed portion 1111 having a central arc-shaped protrusion 1113 positioned between the two notches 1112. The first depressed portion 1111 also has two edges connected to two opposite ends of the protrusion 1113, respectively. The two edges bound outer peripheries of the two notches 1112, respectively. Each of the edges is slightly concave.

Outer surfaces of the first sidewall 112, the second sidewall 113 and the third sidewall 114 are flat. The third sidewall 114 includes a main portion 1141, and an inner end portion 1142 extending from the main portion 1141 and located nearer the impeller 20. A free end of the first sidewall 112, the inner end portion 1142 of the third sidewall 114, and the bottom plate 111 cooperatively define a space therebetween. Thus, when the top cover 12 is engaged with the base 11, the top cover 12 and the base 11 cooperatively define an air inlet 115. A free end of a flat portion 1131 of the second sidewall 113, an outer end of the main portion 1141 of the third sidewall 114, and the bottom plate 111 cooperatively define a space therebetween. Thus, when the top cover 12 is engaged with the base 11, the top cover 12 and the base 11 cooperatively define an air outlet 116. The air inlet 115 is generally adjacent to and generally perpendicular to the air outlet 116, with the third sidewall 114 being located between the air inlet 115 and the air outlet 116.

An inner surface of the first sidewall 112 near the air inlet 115 extends toward the impeller 20 to form a bulge 1121. As can be seen in FIG. 3, a lateral side of the bulge 1121 at the air inlet 115 is aligned with the corresponding edge of the first depressed portion 1111 that bounds the periphery of the corresponding notch 1112. Inner ends of the first sidewall 112 and the second sidewall 113 are connected to cooperatively form an arc-shaped inner wall 117. The arc-shaped inner wall 117 is spaced from the impeller 20 to define a channel 118 for air to flow from the air inlet 115 to the air outlet 116. A transverse (horizontal) width of the channel 118 gradually increases from an end of the channel nearer the air inlet 115 to an end of the channel nearer the air outlet 116.

The second sidewall 113 includes the flat portion 1131 extending from an end of the arc-shaped inner wall 117. The air outlet 116 is defined between the free end of the flat portion 1131, the outer end of the main portion 1141 of the third sidewall 114, the bottom plate 111 and the top cover 12.

The third sidewall 114 is located at a corner of the bottom plate 111 diagonally opposite from the arc-shaped inner wall 117. A lateral side of the inner end portion 1142 at the air inlet 115 is aligned with the corresponding edge of the first depressed portion 1111 that bounds the periphery of the corresponding notch 1112.

The top cover 12 is flat. One side of the top cover 12 at the air inlet 115 is cut to form a second depressed portion 121. A projection of the second depressed portion 121 on the bottom plate 111 overlaps and is aligned with the first depressed portion 1111. That is, the second depressed portion 121 has a size and shape corresponding to the first depressed portion 1111. The second depressed portion 121 and the first depressed portion 1111 are configured such that a part of the impeller 20 is exposed out of the frame 10; thus, the air inlet 115 is increased in size.

The impeller 20 is received in the receiving space 13 of the frame 10. The impeller 20 includes a hub 21, a plurality of blades 22 surrounding the hub 21, and a connecting portion 23 interconnecting the hub 21 and the blades 22. The hub 21 is located at a center of the bottom plate 111. A bearing system (not shown) and electrical circuits (not shown) are disposed in the hub 21, so that the hub 21 can be driven to rotate.

A minimum distance (clearance) between the inner end portion 1142 and a nearest one of the blades 22 is substantially equal to a minimum distance (clearance) between the bulge 1121 and a nearest one of the blades 22, and is smaller than a smallest transverse width of the channel 118.

The connecting portion 23 of the impeller 20 includes a latching ring 231, and a plurality of spokes 232 interconnecting the hub 21 and the latching ring 231. The latching ring 231 has a flat top surface and a flat bottom surface. The blades 22 are snapped onto the latching ring 231 along radial directions of the impeller 20. A height of each blade 22 is smaller than that of each of the first sidewall 112, the second sidewall 113 and the third sidewall 114.

Referring to FIG. 3, when the heat dissipating fan 100 is in operation, the impeller 20 rotates in a clockwise direction, and air is driven to flow into the air inlet 115, along the channel 118, and out of the air outlet 116. Since the distance between the inner end portion 1142 of the third sidewall 114 and the impeller 20 is small, and the inner end portion 1142 is curved slightly at the air inlet 115, the inner end portion 1142 helps prevent air flowing into the air outlet 116 directly from the air inlet 115, and helps prevent air at the air outlet 116 escaping back into the air inlet 115.

In summary, the heat dissipating fan 100 is provided with the air inlet 115 at a lateral side thereof and the air outlet 116 at a lateral side thereof. Unlike with a traditional heat dissipating fan, there is no need to provide a gap for airflow between the housing of an electronic device and the top cover 12, and there is no need to provide a gap for airflow between the electronic device and the bottom plate 111. When the heat dissipating fan 100 is employed in an electronic device having a given low profile, the heat dissipating fan 100 has a relatively long axial dimension. Therefore the amount of airflow in the frame 10 is improved, and the air in the frame 10 can flow fully and effectively with high heat dissipating performance. In addition, the bearing system of the heat dissipating fan 100 can have a large thickness. This means the supporting strength of the bearing is improved, and the volume of oil in the bearing system is increased. Thus, the heat dissipating fan 100 can have good stability and a long working lifetime.

Figure 4:
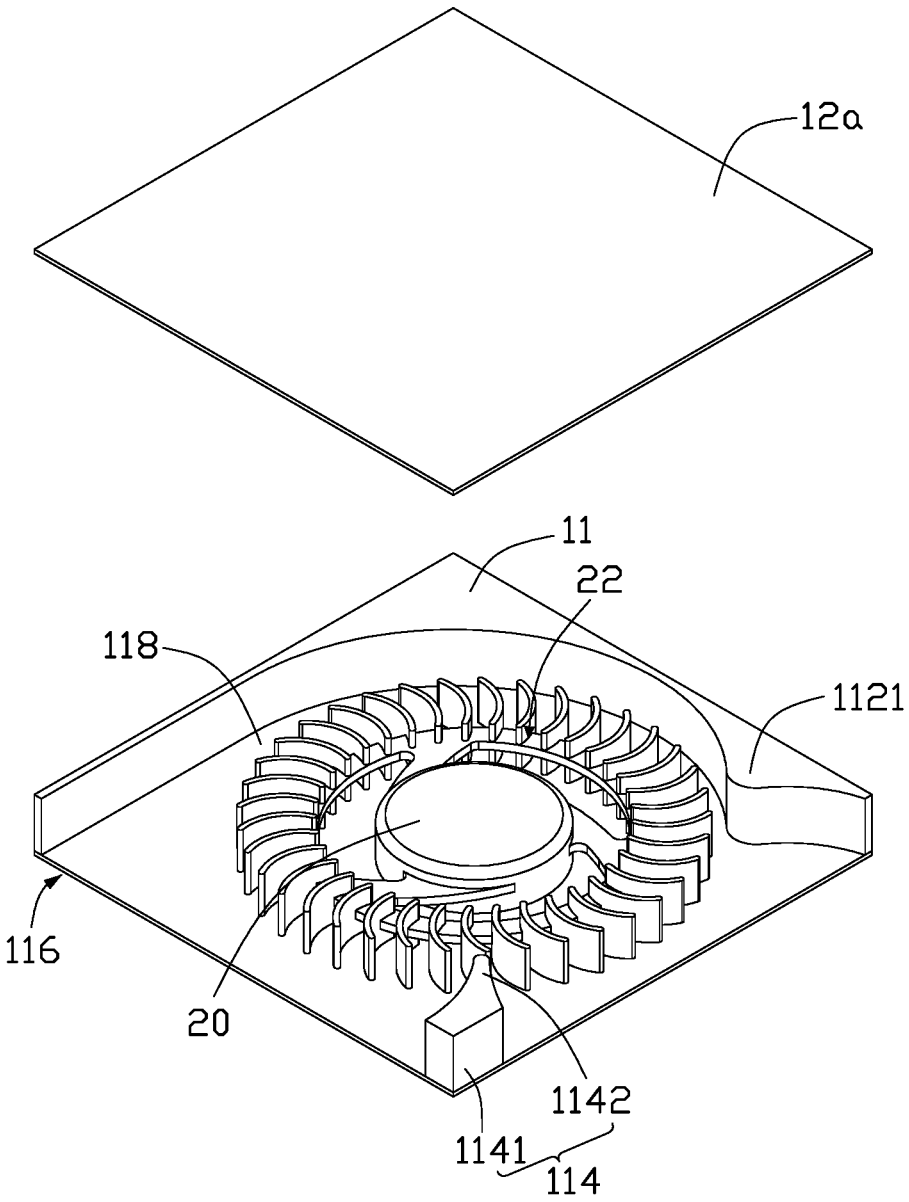
FIG. 4 is an exploded, isometric view of a heat dissipating fan in accordance with another embodiment of the disclosure.
Figure 5:
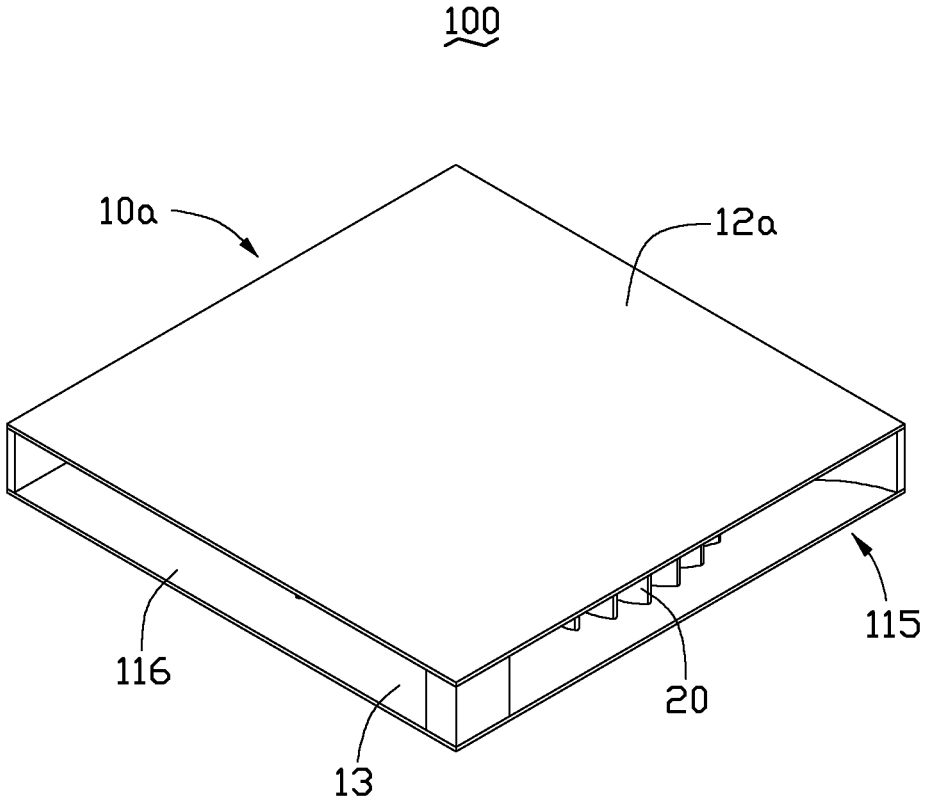
FIG. 5 is an assembled view of the heat dissipating fan of FIG. 4.
Figure 6:
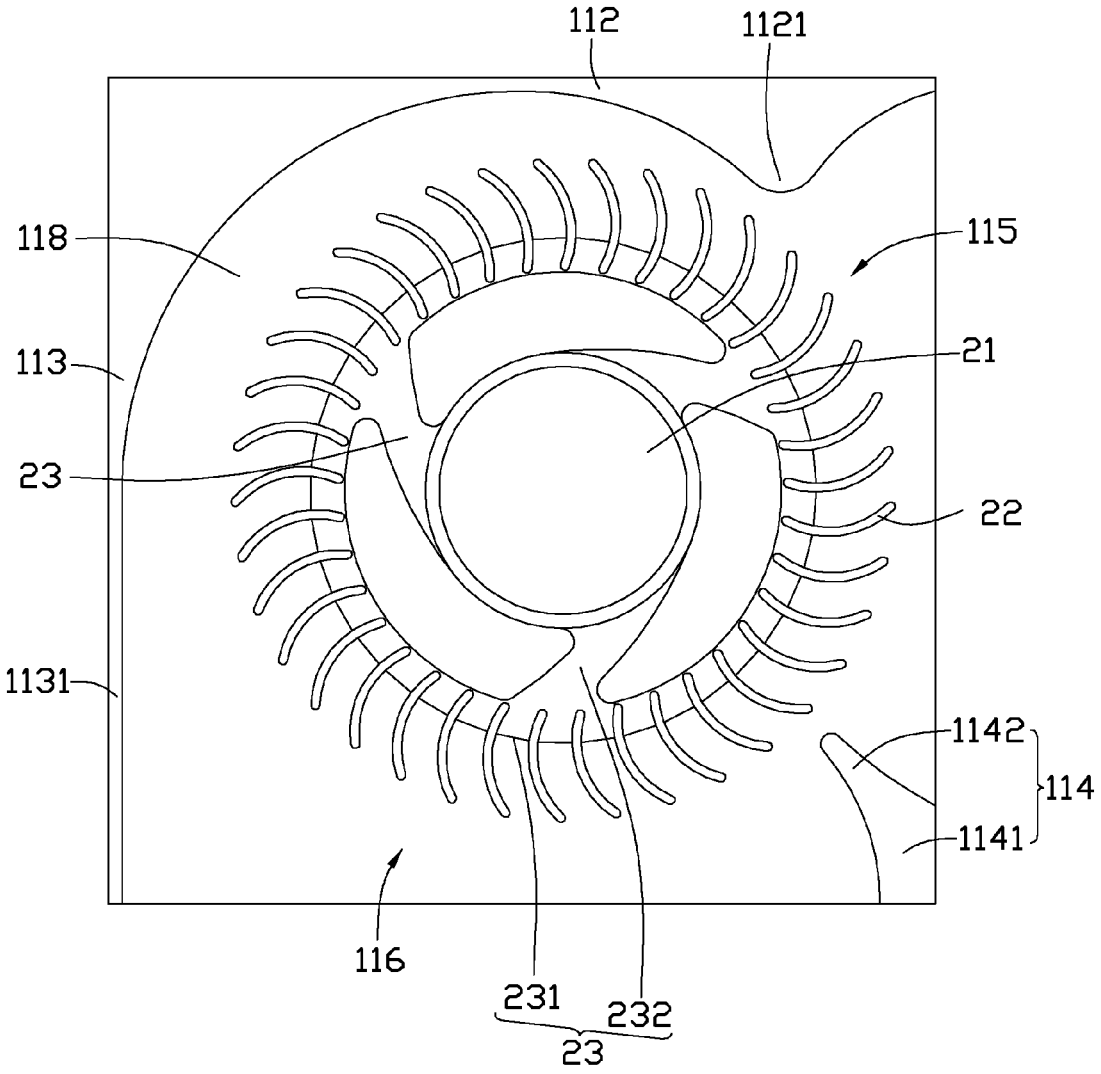
FIG. 6 is a top plan view of the heat dissipating fan of FIG. 4, wherein a top cover thereof is omitted.

Referring to FIG. 4 through FIG. 6, a heat dissipating fan 200 in accordance with another exemplary embodiment is shown. A structure of the heat dissipating fan 200 is similar to that of the heat dissipating fan 100 of the previous embodiment. One main difference is that a top cover 12*a* and a bottom plate 111 of the heat dissipating fan 200 are square and flat, so that the impeller 20 is entirely received in a frame 10*a*. Another main difference is that the impeller 20 is essentially inverted, whereby the impeller 20 rotates in a counterclockwise direction (rather than a clockwise direction). Thus the configuration of other parts of the heat dissipating fan 200 is substantially a mirror image of the configuration of corresponding parts of the heat dissipating fan 100.

It is to be understood that the above-described embodiments are intended to illustrate rather than limit the disclosure. Variations may be made to the embodiments without departing from the spirit of the disclosure. The above-described embodiments illustrate the scope of the disclosure but do not restrict the scope of the disclosure.

What is claimed is:

1. A heat dissipating fan, comprising:

a frame comprising a base and a top cover disposed on the base, the base comprising a bottom plate, a first sidewall, a second sidewall connecting to the first sidewall, and a third sidewall spaced from the first sidewall and the second sidewall;

an impeller rotatably received in the frame;

an air inlet, the top cover, the bottom plate, the first sidewall and the third sidewall cooperatively defining the air inlet therebetween; and an air outlet, the top cover, the bottom plate, the second sidewall and the third sidewall cooperatively defining the air outlet therebetween;

wherein a portion of the bottom plate positioned between the first sidewall and the third sidewall is cut to form a first depressed portion, and the first depressed portion is generally W-shaped, with the first depressed portion defining two symmetrical notches, having a central arc-shaped protrusion positioned between the two symmetrical notches, and two edges connected to two opposite ends of the central arc-shaped protrusion, respectively.

2. The heat dissipating fan of claim 1, wherein the impeller comprises a hub, a plurality of blades surrounding the hub, and a connecting portion interconnecting the hub and the plurality of blades.

3. The heat dissipating fan of claim 2, wherein the connecting portion of the impeller comprises a latching ring, and a plurality of spokes interconnecting the hub and the latching ring, the latching ring having a flat top surface and a flat bottom surface.

4. The heat dissipating fan of claim 2, wherein inner ends of surfaces of the first sidewall and the second sidewall are connected to cooperatively form an arc-shaped inner wall, the arc-shaped inner wall being spaced from the impeller to define a channel, the third sidewall being located at a corner of the bottom plate diagonally opposite from the arc-shaped inner wall.

5. The heat dissipating fan of claim 4, wherein an inner surface of the first sidewall near the air inlet extends toward the impeller to form a bulge, the third sidewall comprises an inner end portion extending toward the impeller, and a minimum distance between the inner end portion and a nearest one of the blades is substantially equal to a minimum distance between the bulge and a nearest of the plurality of blades, and is smaller than a minimum width of the channel.

6. The heat dissipating fan of claim 1, wherein outer surfaces of the first sidewall, the second sidewall and the third sidewall are flat.

7. The heat dissipating fan of claim 1, wherein the bottom plate and the top cover are flat.

8. The heat dissipating fan of claim 1, wherein the two edges bound outer peripheries of the two symmetrical notches respectively, and each of the edges is slightly concave.

9. The heat dissipating fan of claim 8, wherein one side periphery of the top cover at the air inlet is cut to form a second depressed portion, and a projection of the second depressed portion on the bottom plate overlaps and is aligned with the first depressed portion.

10. The heat dissipating fan of claim 9, wherein the second depressed portion and the first depressed portion are configured such that a part of the impeller is exposed out of the frame.

11. The heat dissipating fan of claim 1, wherein the top cover and the bottom plate of the heat dissipating fan are square and flat, so that the impeller is entirely received in the frame.

12. A heat dissipating fan, comprising:

a frame comprising a base and a top cover disposed on the base, the base comprising a bottom plate and a peripheral sidewall, the peripheral sidewall extending between the bottom plate and the top cover, and the base and the top cover cooperatively defining a receiving space;

an impeller rotatably received in the receiving space;

an air inlet, the top cover, the bottom plate and the peripheral sidewall cooperatively defining the air inlet therebetween, with the air inlet communicating with the receiving space; and an air outlet, the top cover, the bottom plate and the peripheral sidewall cooperatively defining the air outlet therebetween, the air outlet being generally adjacent to and substantially perpendicular to the air inlet, with the air outlet communicating with the receiving space;

wherein a portion of the bottom plate positioned between the first sidewall and the third sidewall is cut to form a first depressed portion, and the first depressed portion is generally W-shaped, with the first depressed portion defining two symmetrical notches, having a central arc-shaped protrusion positioned between the two symmetrical notches, and two edges connected to two opposite ends of the central arc-shaped protrusion, respectively, and the first depressed portion being configured such that a part of the impeller is exposed out of the frame.

13. The heat dissipating fan of claim 12, wherein the peripheral side wall comprises a first sidewall, a second sidewall and a third sidewall, the air outlet being defined among the top cover, the bottom plate, the first sidewall and the third sidewall, and the air inlet being defined among the top cover, the bottom plate, the second sidewall and the third sidewall.

14. The heat dissipating fan of claim 13, wherein an inner surface of the first sidewall near the air inlet extends toward the impeller to form a bulge, the third sidewall comprises an inner end portion extending toward the impeller, and a minimum distance between the inner end portion and a nearest one of a plurality of blades of the impeller is substantially equal to a minimum distance between the bulge and a nearest of the plurality of blades, and is smaller than a minimum width of the channel.

15. The heat dissipating fan of claim 12, wherein one side periphery of the top cover at the air inlet is cut to form a second depressed portion, the second depressed portion being generally W-shaped, the second depressed portion defining two symmetrical notches, with the second depressed portion having a central arc-shaped protrusion positioned between the two symmetrical notches, the second depressed portion also having two edges connected to two opposite ends of the central arc-shaped protrusion respectively, and the second depressed portion being configured such that a part of the impeller is exposed out of the frame.

* * * * *